US010654056B1

(12) United States Patent
Nguyen et al.

(10) Patent No.: US 10,654,056 B1
(45) Date of Patent: May 19, 2020

(54) CHARGE ASSISTED SPRAY DEPOSITION METHOD AND APPARATUS

(71) Applicant: Clearist Inc., Milpitas, CA (US)

(72) Inventors: Paul P. Nguyen, San Jose, CA (US); Nelson Rob Holcomb, Morgan Hill, CA (US)

(73) Assignee: Clearist Inc., Milpitas, CA (US)

( * ) Notice: Subject to any disclaimer, the term of this patent is extended or adjusted under 35 U.S.C. 154(b) by 0 days.

(21) Appl. No.: 16/029,771

(22) Filed: Jul. 9, 2018

Related U.S. Application Data

(62) Division of application No. 14/679,819, filed on Apr. 6, 2015, now abandoned.

(60) Provisional application No. 61/975,827, filed on Apr. 6, 2014.

(51) Int. Cl.

| | |
|---|---|
| ***B05D 1/04*** | (2006.01) |
| ***B05B 7/22*** | (2006.01) |
| ***C23C 4/126*** | (2016.01) |
| ***B05B 5/03*** | (2006.01) |

(52) U.S. Cl.
CPC ..... *B05B 7/222* (2013.01); *B05B 5/032* (2013.01); *C23C 4/126* (2016.01)

(58) Field of Classification Search
CPC ..... C23C 4/126
See application file for complete search history.

(56) References Cited

U.S. PATENT DOCUMENTS

| | | | | |
|---|---|---|---|---|
| 4,020,792 | A * | 5/1977 | Jordan | B05B 5/087 118/629 |
| 4,748,043 | A | 5/1988 | Seaver et al. | |
| 4,971,818 | A | 11/1990 | Pye | |
| 5,051,159 | A | 9/1991 | Togashi et al. | |
| 5,279,863 | A | 1/1994 | Escallon | |
| 5,326,598 | A * | 7/1994 | Seaver | B05B 5/0255 427/473 |
| 5,344,676 | A | 9/1994 | Kim et al. | |
| 5,749,529 | A * | 5/1998 | Kazama | B05B 5/03 118/626 |
| 6,093,557 | A * | 7/2000 | Pui | C12N 15/895 435/173.1 |

(Continued)

*Primary Examiner* — Dah-Wei D. Yuan
*Assistant Examiner* — Kristen A Dagenais-Englehart
(74) *Attorney, Agent, or Firm* — Caesar Rivise, PC

(57) ABSTRACT

A deposition method includes: (1) providing a nozzle structure including: (a) at least one corona generator having an elongated charge emitting surface; and (b) at least one aerosol channel adapted to guide an aerosol along a flow path past the at least one corona generator; (2) generating an aerosol of a precursor solution; (3) applying to the at least one corona generator a positive or negative voltage of 1 kV-100 kV with respect to the substrate to generate a corona; and (4) flowing the aerosol through the at least one aerosol channel, along the flow path near the at least one corona generator and toward the surface of the substrate so as to charge the aerosol with ions emitted from the at least one corona generator to form charged droplets which are attracted to and deposited on the substrate, wherein the elongated charge emitting surface is a wire or blade edge, which is substantially parallel to the surface of the substrate and substantially perpendicular to the flow path, provided that the at least one corona generator does not consist of two blades. Inventive nozzle structures are also described.

23 Claims, 5 Drawing Sheets

(56) References Cited

U.S. PATENT DOCUMENTS

| | | | | |
|---|---|---|---|---|
| 6,331,330 | B1 * | 12/2001 | Choy | B05D 1/04 427/314 |
| 7,586,092 | B1 * | 9/2009 | Karpetsky | G01N 27/624 250/281 |
| 2007/0018361 | A1 * | 1/2007 | Xu | C04B 35/62236 264/465 |
| 2007/0048452 | A1 * | 3/2007 | Feng | B05B 5/0255 427/458 |
| 2007/0157880 | A1 * | 7/2007 | Tanioka | B05B 5/025 118/621 |
| 2007/0278103 | A1 * | 12/2007 | Hoerr | A61L 27/34 205/80 |
| 2008/0054099 | A1 * | 3/2008 | Giroux | B05B 7/0869 239/337 |
| 2008/0063971 | A1 * | 3/2008 | Watanabe | G03G 9/0804 430/110.4 |
| 2011/0088931 | A1 * | 4/2011 | Lettow | B82Y 30/00 174/257 |

* cited by examiner

CHARGE ASSISTED SPRAY DEPOSITION METHOD AND APPARATUS

CROSS-REFERENCE TO RELATED APPLICATIONS

This application is a division of U.S. application Ser. No. 14/679,819, filed Apr. 6, 2015, which claims the benefit of U.S. Application No. 61/975,827, filed Apr. 6, 2014, the contents of which applications are incorporated herein by reference in their entireties for all purposes.

BACKGROUND OF THE INVENTION

1. Field of Invention

This invention relates to the field of thin film deposition, and more particularly, to an electrospray technique and apparatus.

2. Description of Related Art

Different techniques for thin film deposition have been used, including sputtering, evaporation, chemical vapor deposition, spray pyrolysis, electrostatic spray pyrolysis, flame spray deposition, etc.

Among the various thin film deposition techniques, electrostatic spray pyrolysis, or electrospray, is one of the fastest, simplest, and lowest-cost. The electrospray technique involves passing a precursor solution through at least one capillary sharp tip held at high potential pointing toward a grounded substrate. The effect of the high electric field as the solution emerges is to generate an aerosol of highly charged droplets which pass down a potential and pressure gradient towards the grounded substrate. Due to Coulomb repulsion among the charged droplets, the electrically generated droplets spread out into a cone as they travel from the capillary tip towards the substrate. The applied high voltage to the tip is kept below the corona discharge threshold to reduce the chance of an electric breakdown.

The electrospray technique suffers from several drawbacks including non-uniform coating over a large substrate area, low deposition rate, and strong dependence upon the precursor's electrical characteristics.

BRIEF SUMMARY OF THE INVENTION

A first aspect of the invention is a method for depositing a material onto a surface of a substrate, comprising the steps of: (1) providing a nozzle structure comprising: (a) at least one corona generator having an elongated charge emitting surface; and (b) at least one aerosol channel adapted to guide an aerosol along a flow path past the at least one corona generator; (2) generating an aerosol of a precursor solution; (3) applying to the at least one corona generator a positive or negative voltage of 1 kV-100 kV with respect to the substrate to generate a corona; and (4) flowing the aerosol through the at least one aerosol channel, along the flow path near the at least one corona generator and toward the surface of the substrate so as to charge the aerosol with ions emitted from the at least one corona generator to form charged droplets which are attracted to and deposited on the substrate, wherein the elongated charge emitting surface is a wire or blade edge, which is substantially parallel to the surface of the substrate and substantially perpendicular to the flow path, provided that the at least one corona generator does not consist of two blades.

In certain embodiments, the corona generator is a wire which is 10 μm-10 mm in diameter.

In certain embodiments, the corona generator comprises two wires each of which is 10 μm-10 mm in diameter.

In certain embodiments, the at least one corona generator comprises a blade at an angle of 0-90° with respect to the substrate surface and optionally covered with a non-conductive material everywhere other than the cutting edge.

In certain embodiments, the corona generator is continuously or periodically moved along its length so that a portion of the corona generator outside of a deposition area can be cleaned without affecting deposition.

In certain embodiments, a shroud gas is blown over the corona generator towards the substrate to prevent the aerosol and a backflow thereof from flowing into and contaminating the corona generator.

In certain embodiments, the substrate comprises glass, silicon or metal.

In certain embodiments, the inventive method further comprises the step of heating the substrate to a temperature of 150-700° C.

In certain embodiments, the aerosol is generated from a precursor solution using a pneumatic, hydraulic, ultrasonic, vibrating mesh, or other atomizing techniques.

In certain embodiments, the aerosol comprises droplets having an average diameter of 50 nm to 50 μm.

In certain embodiments, the aerosol comprises droplets having an average diameter of 200 nm to 10 μm.

In certain embodiments, the carrier gas comprises at least one gas selected from the group consisting of air, $N_2$, Ar, $O_2$, $H_2$, He, and combinations thereof.

In certain embodiments, the nozzle structure is composed of an electrically insulating material.

In certain embodiments, a plurality of hooks is provided to hold and reduce vibration of the corona generator.

In certain embodiments, a metallic roller or metallic brush is used on a back side of the substrate to establish an electrical connection to the substrate surface on which the droplets are deposited.

In certain embodiments, a gas shroud is provided along an inside wall of the at least one aerosol channel to reduce a number of droplets that hit an inside wall thereof.

In certain embodiments, an upper portion of the nozzle structure is bent such that droplets landing on walls of the nozzle structure flow away from an aerosol emitting orifice by gravity.

In certain embodiments, a lower portion of the nozzle structure has a shroud gas flow to reduce the number of droplets landing on walls of the nozzle structure.

In certain embodiments, at least one neutralizing corona generator is provided 1 cm to 1 m away from the corona generator and biased to a voltage having an opposite polarity as that of the nozzle structure, such that charges generated are approximately equal and opposite to charges generated from the nozzle structure, leading to a neutralized charge balance on the substrate surface.

In certain embodiments, the substrate is coated with a conductive material.

A second aspect of the invention is a nozzle structure for depositing a material onto a surface of a substrate, comprising: (a) at least one corona generator having an elongated charge emitting surface; and (b) at least one aerosol channel adapted to guide an aerosol along a flow path past the at least one corona generator such that the aerosol is charged with ions emitted from the at least one corona generator to form charged droplets which are attracted to and deposited on the substrate, wherein the elongated charge emitting surface is a wire or blade edge, which is adapted to be positioned substantially parallel to the surface of the substrate and substantially perpendicular to the flow path, provided that the at least one corona generator does not consist of two blades.

In certain embodiments of the second aspect of the invention, the corona generator is a wire which is 10 μm-10 mm in diameter.

In certain embodiments of the second aspect of the invention, the corona generator comprises two wires each of which is 10 μm-10 mm in diameter.

In certain embodiments of the second aspect of the invention, the corona generator comprises a blade at an angle of 0-90° with respect to the substrate surface and optionally covered with a non-conductive material everywhere other than the cutting edge.

In certain embodiments of the second aspect of the invention, the at least one corona generator is adapted to be continuously or periodically moved along its length so that a portion of the at least one corona generator outside of a deposition area can be cleaned without affecting deposition.

In certain embodiments of the second aspect of the invention, the nozzle structure is adapted to blow a shroud gas over the at least one corona generator towards the substrate to prevent the aerosol and a backflow thereof from flowing into and contaminating the at least one corona generator.

In certain embodiments of the second aspect of the invention, the nozzle structure is composed of an electrically insulating material.

In certain embodiments of the second aspect of the invention, the nozzle structure further comprises a plurality of hooks adapted to hold and reduce vibration of the at least one corona generator.

In certain embodiments of the second aspect of the invention, the nozzle structure is adapted to provide a gas shroud along an inside wall of the at least one aerosol channel to reduce a number of droplets that hit an inside wall thereof.

In certain embodiments of the second aspect of the invention, an upper portion of the nozzle structure is bent such that droplets landing on walls of the nozzle structure flow away from an aerosol emitting orifice by gravity.

In certain embodiments of the second aspect of the invention, the nozzle structure is adapted to provide a lower portion of the nozzle structure with a shroud gas flow to reduce the number of droplets landing on walls of the nozzle structure.

In certain embodiments of the second aspect of the invention, at least one neutralizing corona generator is provided 1 cm to 1 m away from the at least one corona generator and biased to a voltage having an opposite polarity as that of the nozzle structure, such that charges generated are approximately equal and opposite to charges generated from the nozzle structure, leading to a neutralized charge balance on the substrate surface.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF PREFERRED EMBODIMENTS OF THE INVENTION

We introduce a new and improved electrospray technique that we name the "Charge Assisted Spray Deposition" (CASP) Technique and corresponding nozzle structures that can deposit films that are uniform, fast, independent of the electrical characteristics of the precursor, high efficiency, and low cost.

Nozzle Structure

A nozzle structure in accordance with the invention comprises an aerosol source section, an aerosol spreader section, a charge generating section, an optional shroud gas section and an optional snout section.

The aerosol source section includes at least one atomizing unit (atomizer). An aerosol can be generated from a precursor solution using pneumatic, hydraulic, ultrasonic, vibrating mesh, or other atomizing techniques.

A carrier gas is used to carry the droplets forward through the rest of the nozzle structure, exiting at least one orifice, such as, e.g., two identical orifices. Each orifice is preferably rectangular with a width from 0.01 mm to 1 m (more preferably 0.1 mm to 100 mm) and a length from 10 mm to 100 m (preferably from 100 mm to 10 m). In the case of two orifices, the two orifices are oriented preferably opposite to and at an angle of about 45 degrees with respect to the surface of the substrate. Carrier gases can be air, nitrogen, argon, oxygen, hydrogen, helium, xenon, carbon dioxide, water vapor, alcohol vapor, or combination.

Figure 1A:
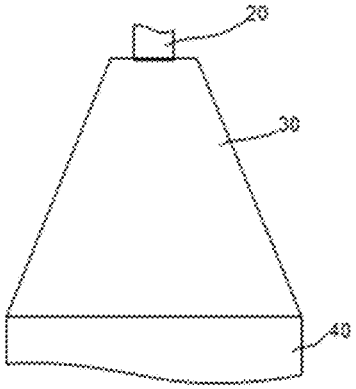
FIG. 1A shows a front view of an embodiment of a spreader of a nozzle of the invention.
Figure 1B:
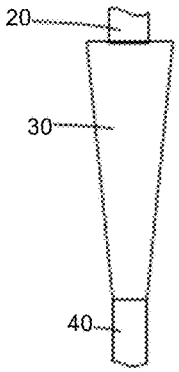
FIG. 1B shows a side view of the spreader of FIG. 1A.

Referring to FIGS. 1A and 1B, the aerosol spreader section comprises a wedge-shaped spreader 30 on each atomizer to spread out and thin down the aerosol along the length of the nozzle. Spreader 30 includes aerosol delivery tube 20 and aerosol output channel 40. Alternatively, a box-like mixing chamber can be used where the aerosol coming in from one or several small orifices can get spread out via vortices and turbulence.

The thin edge of the wedge leads into a thin rectangular guide to continue the spreading to make the aerosol density uniform along the length of the nozzle.

Figure 2:
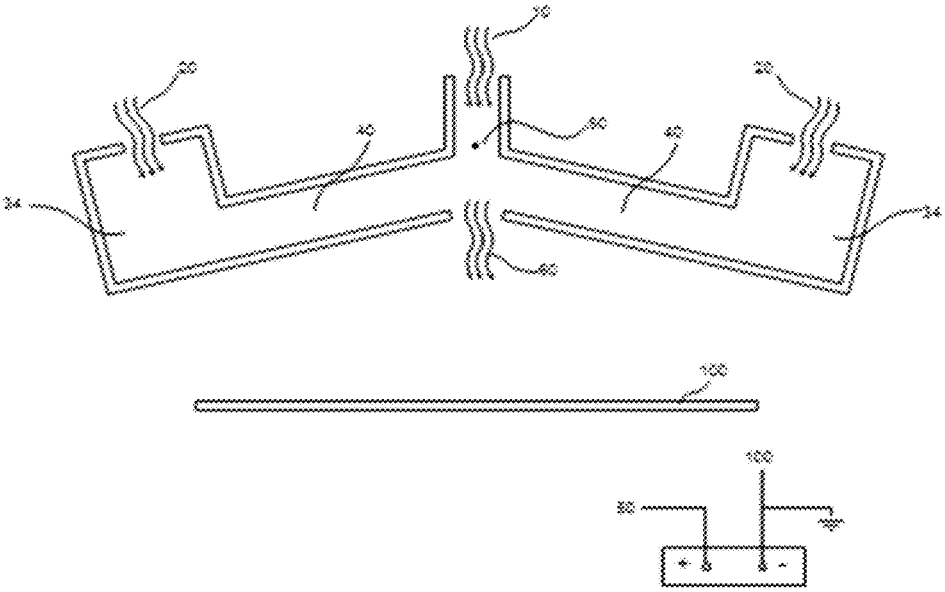
FIG. 2 shows a schematic cross-sectional view of another embodiment of the inventive nozzle comprising one center corona wire and slanted aerosol channels to collect droplets hitting the nozzle walls.
Figure 3:
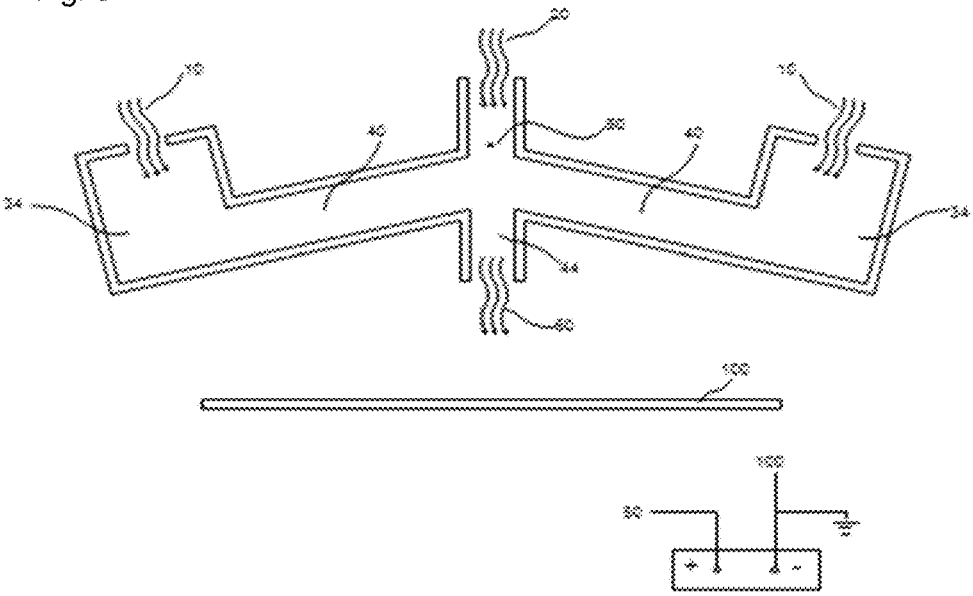
FIG. 3 shows a schematic cross-sectional view of another embodiment of the inventive nozzle comprising one center corona wire, slanted aerosol channels and a snout for guiding the aerosol to the substrate.
Figure 4:
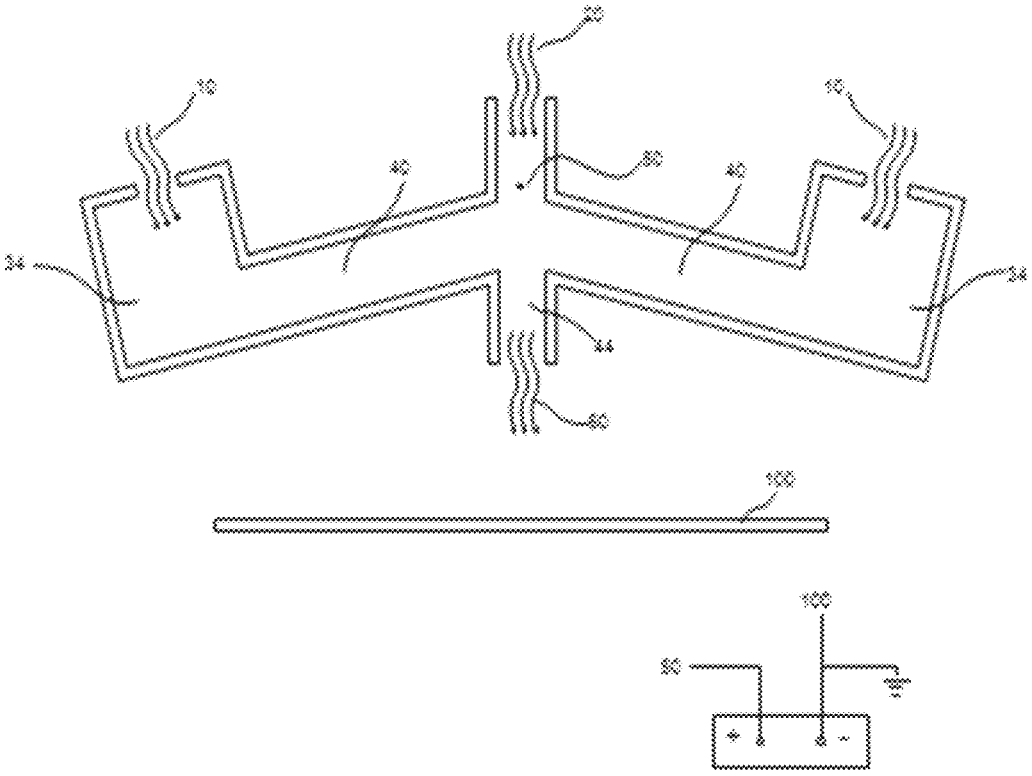
FIG. 4 shows a schematic cross-sectional view of another embodiment of the inventive nozzle comprising one center corona wire, slanted aerosol channels and a snout for guiding the aerosol to the substrate.
Figure 5:
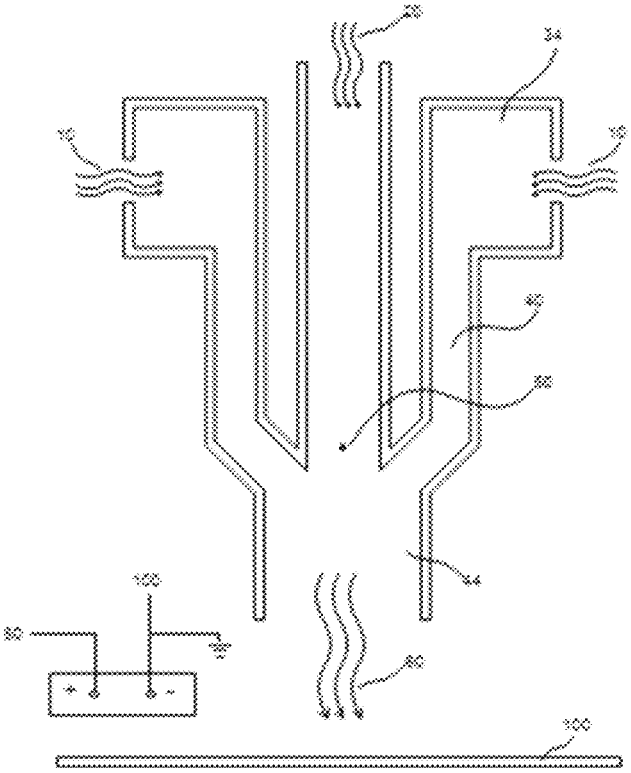
FIG. 5 shows a schematic cross-sectional view of another embodiment of the inventive nozzle comprising one center corona wire, a vertical aerosol channel and a snout.

Optionally, most of the spreading portion of the nozzle can be slanted and positioned so that aerosol droplets landing on the wall flow back via gravity into the precursor source. See, e.g., FIGS. 2-4, which show slanted mixing chambers 34 from which aerosol 20 is conveyed through aerosol channels 40 toward substrate 100 in the form of charged output aerosol 60.

The charge generating section comprises at least one corona generator (e.g., corona wire 50 of FIGS. 2-4), which is preferably at least one metallic wire stretched taut along the nozzle's length and/or at least one metallic blade with a sharp edge positioned along the nozzle's length.

Figure 6:
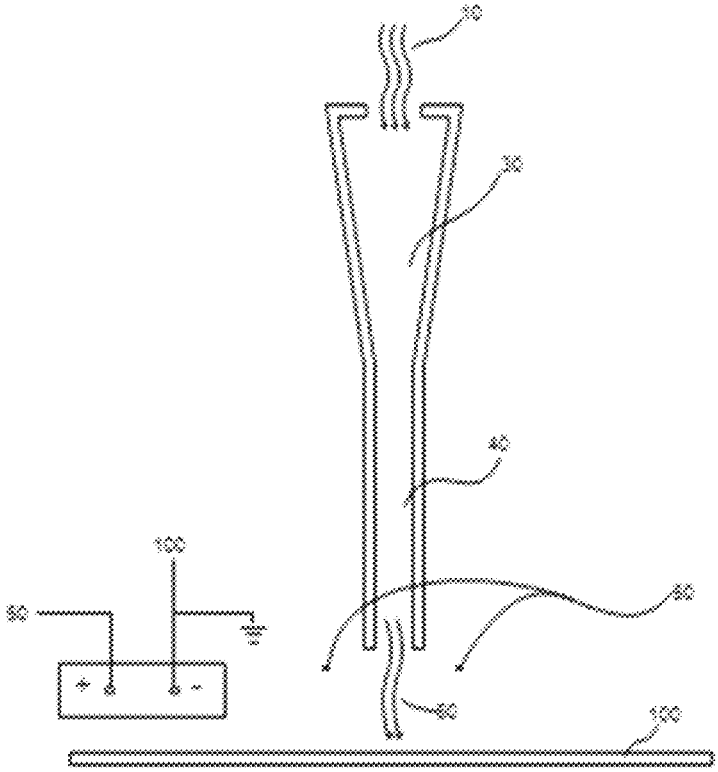
FIG. 6 shows a schematic cross-sectional view of another embodiment of the inventive nozzle comprising two side corona wires.

The wire (or blade) is placed in the middle channel of the nozzle, as shown, e.g., in FIGS. 2-5. Alternatively, metallic wires (or alternatively metallic blades with sharp cutting edges) are placed on either or both sides of the orifice from which the aerosol is emitted. The wires (or blade edges) are preferably placed outside of the orifice and close to but away from the aerosol flow stream. See, e.g., corona wires 50 of FIGS. 6-8.

The wire or blade is thin enough (from 100 nm to 10 cm, preferably from 1000 nm to 1 cm, in diameter of curvature) to generate a corona discharge with an applied voltage (preferably 1-1000 kV, more preferably 5-100 kV).

There may be several hooks to hold the wires (or blades) and reduce vibration.

Figure 7:
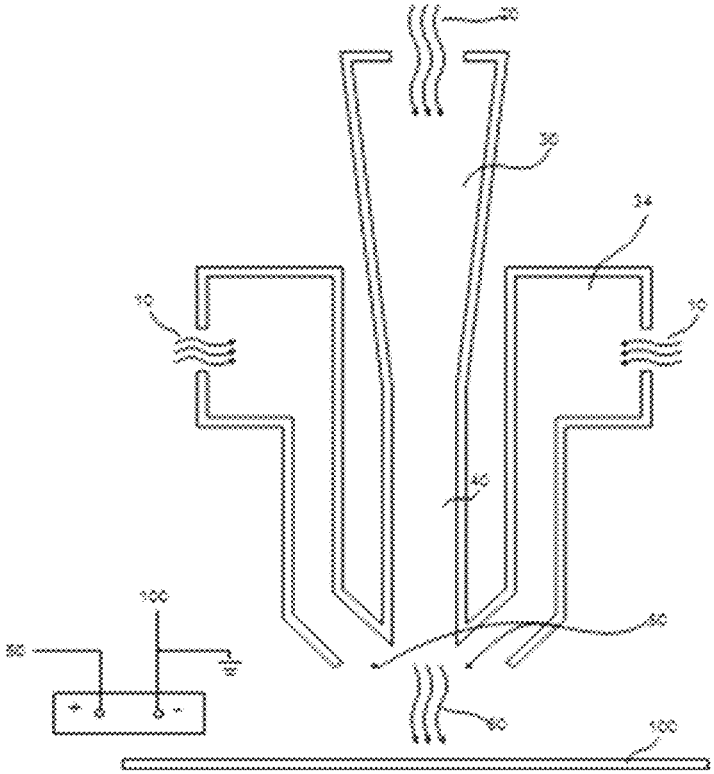
FIG. 7 shows a schematic cross-sectional view of another embodiment of the inventive nozzle comprising two side corona wires and shroud gas.
Figure 8:
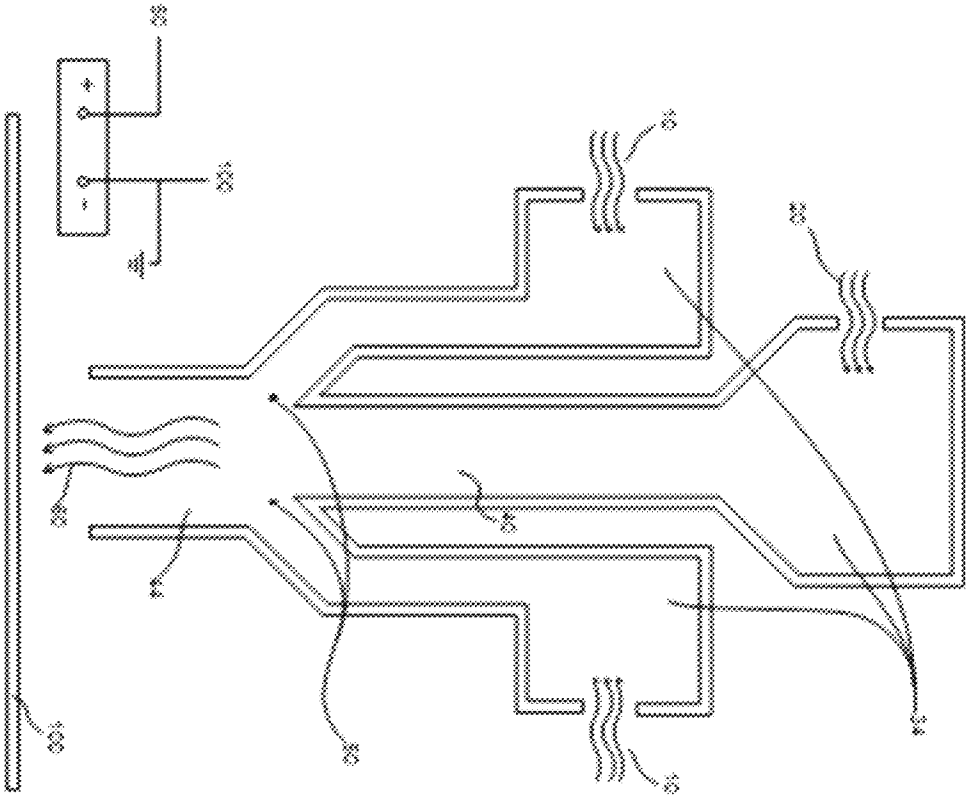
FIG. 8 shows a schematic cross-sectional view of another embodiment of the inventive nozzle comprising two side corona wires, shroud gas and a snout.

The shroud gas section of the nozzle structure is optional. FIG. 7 shows an embodiment nozzle with shroud gas 10 around dual corona wires 50. FIG. 8 shows a nozzle with snout 44 and with shroud gas 10 over dual corona wires 50. This embodiment has box-like mixing chambers 34 at the top. The shroud gas 10 is flowed along the walls of the snout 44 to reduce the number of droplets landing on the wires/blades and snout walls.

Shroud gases can be air, nitrogen, argon, oxygen, hydrogen, helium, xenon, carbon dioxide, water vapor, alcohol vapor, or combination.

The snout section of the nozzle structure is optional. As shown in, e.g., FIGS. 3, 4 and 8, snout 44 can be added between the charge generating section and substrate 100 to help guide the aerosol 60 to substrate 100.

Optionally, cooling mechanisms can be added to the orifice and/or the snout when the substrate is heated to above room temperature.

The invention will be illustrated in more detail with reference to the following Examples, but it should be understood that the present invention is not deemed to be limited thereto.

EXAMPLES

Example 1

A thin film can be deposited on a substrate by the following procedure. Referring to FIGS. 2-8, substrate 100 is placed on a grounded metal support about 1 mm and 500 mm from the at least one corona generator (e.g., wire 50). The substrate and its support can optionally be moved with respect to the nozzle, at a speed between 1 cm/min and 100 m/min. The substrate 100 (which is preferably glass or silicon) is heated to 200-600° C.

A precursor solution of tungsten chloride $WCl_6$ is prepared by diluting $WCl_6$ in 50% ethanol and 50% water at a concentration between 0.01M and 0.1M.

The precursor solution is aerosolized with standard commercial atomizers.

Using nitrogen as a carrier gas, the aerosol is moved through the tubes into the nozzle which makes it uniform and flattened upon exit from the orifice.

A voltage from +10 kV to +100 kV is applied to the wires (or blades) to produce corona discharges. The ions generated charge the aerosol droplets most of which are then attracted to the grounded substrate. On the substrate surface, the droplets dry up as chemical reactions take place to form a film. The non-charged or inadequately charged droplets and byproducts are swept away by exhaust ducts placed close to the nozzle.

Figure 9:
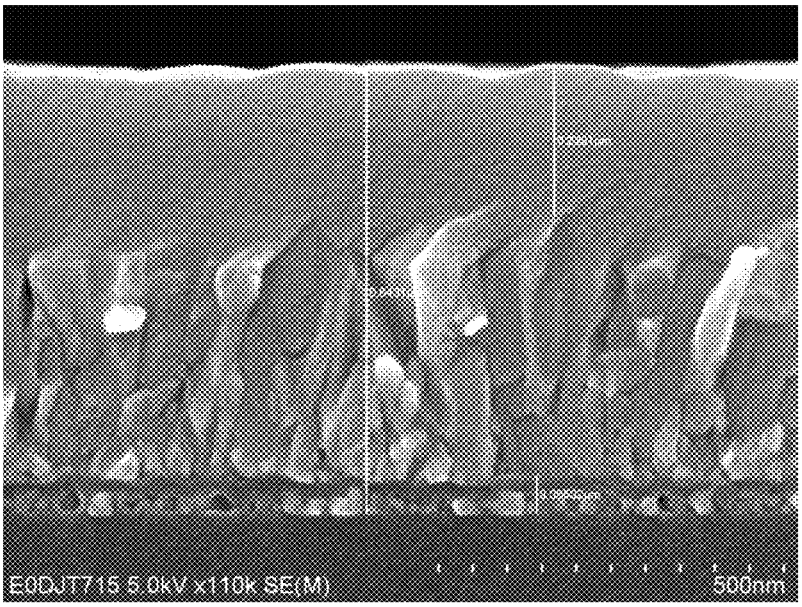
FIGS. 9 and 10 are scanning electron micrograph images of samples prepared according to the invention.

Deposition was conducted in accordance with the foregoing procedure. FIG. 9 shows a SEM image of a roughly 220 nm thin film of $WO_3$ deposited on top of a fluorine-doped tin oxide film using the above process. The $WO_3$ film adheres well to the substrate and is crack-free and smooth, with a peak-to-valley roughness around 10 nm or less. Note that the rough FTO film is planarized quite effectively by the $WO_3$ film.

Example 2

A glass substrate is placed on a grounded metal support about 10 mm and 50 mm from the wires. The substrate and its support can optionally be moved with respect to the nozzle, at a speed between 2 cm/min and 10 m/min. The substrate is heated to a temperature of 500-700° C.

An aluminum doped zinc oxide (AZO) precursor solution is prepared as follows. Zinc acetate dehydrate is dissolved in 2-methoxyethanol at a concentration of 0.75M. Ethanolamine (MEA) is added at a molar ratio of one MEA mole per one Zn mole where MEA acts as a complexion agent to keep the metal ions in homogeneous solution without precipitation. The resulting solution is stirred in a water bath at 70° C. for 2 hours using a magnetic stirrer. Aluminum nitrate is added at a molar ratio of 0.01-0.03 Al to 1 Zn, and the solution is stirred for another hour.

The precursor solution is aerosolized with standard commercial atomizers.

Using nitrogen as a carrier gas, the aerosol is passed through the tubes into the nozzle which makes it uniform and flattened upon exit from the orifice.

A voltage from +10 kV to +100 kV is applied to the wires (or blades) to produce corona discharges. The ions generated charge the aerosol droplets most of which are then attracted to the grounded substrate. On the substrate surface, the droplets dry up as chemical reactions take place to form a film. The non-charged or inadequately charged droplets and byproducts are swept away by exhaust ducts close to the nozzle.

Figure 10:
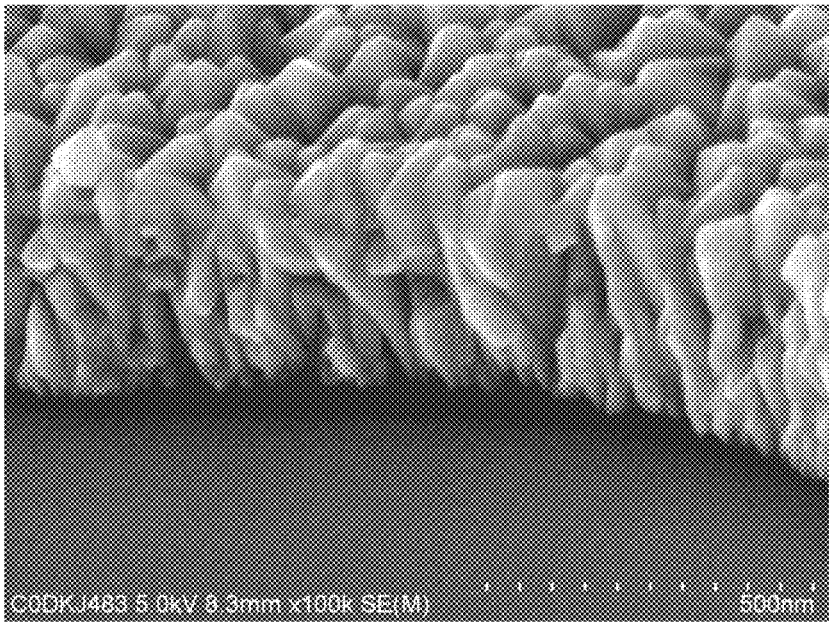

FIG. 10 shows a SEM image of an indium tin oxide film about 400 nm thick deposited in accordance with the foregoing procedure. The film adhered well to the substrate and was polycrystalline, smooth, and crack-free with a peak-to-valley roughness of about 50 nm.

While the invention has been described in detail and with reference to specific examples thereof, it will be apparent to one skilled in the art that various changes and modifications can be made therein without departing from the spirit and scope thereof.

What is claimed is:

1. A method for providing a material on a surface of a substrate, comprising the steps of:

providing a precursor solution comprising at least one precursor material in a liquid;

providing a nozzle structure comprising at least one corona generator having an elongated charge emitting surface which is positioned substantially parallel to the surface of the substrate, wherein the at least one corona generator does not consist of two blades;

supplying the precursor solution to the nozzle structure;

generating an aerosol of the precursor solution in the nozzle structure, wherein the aerosol comprises a plurality of precursor solution droplets suspended within a carrier gas;

applying to the at least one corona generator a positive or negative voltage of 1 kV-100 kV with respect to the substrate to generate a corona;

guiding the aerosol along a flow path substantially perpendicular to the elongated charge emitting surface and sufficiently near the at least one corona generator such that the aerosol is charged with ions emitted from the at least one corona generator to form charged droplets in the aerosol, wherein the at least one corona generator is located outside the flow path;

emitting the aerosol containing the charged droplets from the nozzle structure along a single straight flow path substantially perpendicular to the surface of the substrate, wherein the aerosol is shaped by a spreader of the nozzle structure to make a density of the aerosol uniform along a length of the nozzle structure;

applying a voltage to the surface of the substrate to attract the charged droplets thereto;

depositing the charged droplets onto the surface of the substrate heated to a temperature of 100-700° C.; and forming a solid form of the material to be provided on the surface of the substrate, wherein the solid form of the material is uniformly coated on the surface.

2. The method of claim 1, wherein the at least one corona generator is a wire which is 10 μm-10 mm in diameter.

3. The method of claim 1, wherein the at least one corona generator comprises two wires each of which is 10 μm-10 mm in diameter.

4. The method of claim 1, wherein the at least one corona generator comprises a blade at an angle of 0-90° with respect to the substrate surface and optionally covered with a non-conductive material everywhere other than the cutting edge.

5. The method of claim 1, wherein the at least one corona generator is continuously or periodically moved along its length so that a portion of the at least one corona generator outside of a deposition area can be cleaned without affecting deposition.

6. The method of claim 1, wherein a shroud gas is blown over the at least one corona generator towards the substrate to prevent the aerosol and a backflow thereof from flowing into and contaminating the at least one corona generator.

7. The method of claim 1, wherein the substrate comprises glass, silicon or metal.

8. The method of claim 1, wherein the solid form is a film with a thickness of 220-400 nm and a peak to valley roughness of less than 50 nm.

9. The method of claim 1, wherein the aerosol is generated from the precursor solution using a pneumatic, hydraulic, ultrasonic, vibrating mesh, or other atomizing techniques.

10. The method of claim 1, wherein the precursor solution droplets have an average diameter of 50 nm to 50 μm.

11. The method of claim 10, wherein the average diameter of the precursor solution droplets is 200 nm to 10 μm.

12. The method of claim 1, wherein the carrier gas comprises at least one gas selected from the group consisting of air, $N_2$, Ar, $O_2$, $H_2$, He, and combinations thereof.

13. The method of claim 1, wherein the nozzle structure is composed of an electrically insulating material.

14. The method of claim 13, wherein a plurality of hooks is provided to hold and reduce vibration of the at least one corona generator.

15. The method of claim 1, wherein a metallic roller or metallic brush is used on a back side of the substrate to establish an electrical connection to the substrate surface to which the voltage is applied.

16. The method of claim 1, wherein a gas shroud is provided along an inside wall of the at least one aerosol channel to reduce a number of droplets that hit an inside wall thereof.

17. The method of claim 1, wherein an upper portion of the nozzle structure is bent such that droplets landing on walls of the nozzle structure flow away from an aerosol emitting orifice by gravity.

18. The method of claim 1, wherein a lower portion of the nozzle structure has a shroud gas flow to reduce a number of droplets landing on walls of the nozzle structure.

19. The method of claim 1, wherein at least one neutralizing corona generator is provided 1 cm to 1 m away from the at least one corona generator and biased to a voltage having an opposite polarity as that of the nozzle structure, such that charges generated are approximately equal and opposite to charges generated from the nozzle structure, leading to a neutralized charge balance on the substrate surface.

20. The method of claim 1, wherein the substrate is coated with a conductive material.

21. The method of claim 1, wherein the material provided on the surface of the substrate comprises $WO_3$, Aluminum-doped Zinc Oxide or Indium Tin Oxide.

22. The method of claim 1, wherein the aerosol is shaped into an elongated rectangle as it exits the nozzle.

23. A method for providing a material on a surface of a substrate, comprising the steps of:

providing a precursor solution comprising at least one precursor material in a liquid;

providing a nozzle structure comprising at least one corona generator having an elongated charge emitting surface which is positioned parallel to the surface of the substrate, wherein the at least one corona generator does not consist of two blades;

supplying the precursor solution to the nozzle structure;

generating an aerosol of the precursor solution in the nozzle structure, wherein the aerosol comprises a plurality of precursor solution droplets suspended within a carrier gas;

applying to the at least one corona generator a positive or negative voltage of 1 kV-100 kV with respect to the substrate to generate a corona;

guiding the aerosol along a flow path perpendicular to the elongated charge emitting surface and sufficiently near the at least one corona generator such that the aerosol is charged with ions emitted from the at least one corona generator to form charged droplets in the aerosol, wherein the at least one corona generator is located outside the flow path;

emitting the aerosol containing the charged droplets from the nozzle structure along a single straight flow path perpendicular to the surface of the substrate, wherein the aerosol is shaped by a spreader of the nozzle structure to make a density of the aerosol uniform along a length of the nozzle structure;

applying a voltage to the surface of the substrate to attract the charged droplets thereto;

depositing the charged droplets onto the surface of the substrate heated to a temperature of 100-700° C.; and forming a solid form of the material to be provided on the surface of the substrate, wherein the solid form of the material is uniformly coated on the surface.

* * * * *